US011624168B1

(12) United States Patent
Krumm

(10) Patent No.: US 11,624,168 B1
(45) Date of Patent: Apr. 11, 2023

(54) GRAVEL RECAPTURING AND SIFTING APPARATUS

(71) Applicant: David Krumm, Zeeland, ND (US)

(72) Inventor: David Krumm, Zeeland, ND (US)

( * ) Notice: Subject to any disclaimer, the term of this patent is extended or adjusted under 35 U.S.C. 154(b) by 0 days.

(21) Appl. No.: 17/896,646

(22) Filed: Aug. 26, 2022

Related U.S. Application Data

(60) Provisional application No. 63/343,165, filed on May 18, 2022.

(51) Int. Cl.
*E02F 3/76* (2006.01)

(52) U.S. Cl.
CPC ..... *E02F 3/7604* (2013.01); *E02F 3/7636* (2013.01)

(58) Field of Classification Search
CPC ..... E02F 3/7604; E02F 3/7636; E02F 3/78; E02F 3/783
See application file for complete search history.

(56) References Cited

U.S. PATENT DOCUMENTS 934,630 A * 9/1909 Root ..... E02F 3/7604 172/785
1,014,023 A * 1/1912 Peck ..... E02F 3/7604 172/476
1,499,093 A * 6/1924 Benbow ..... E02F 3/7604 172/785
1,550,858 A * 8/1925 Winsor ..... E02F 3/7604 172/785
1,981,821 A * 11/1934 Beatty ..... E02F 3/7604 172/292
1,983,826 A * 12/1934 Wilson ..... E02F 3/7636 180/315
1,994,817 A * 3/1935 Carla ..... E02F 3/7618 37/235
2,068,433 A * 1/1937 Peterson ..... E01C 23/088 172/438
2,197,549 A * 4/1940 Hargrave ..... E01H 5/12 172/554
2,497,778 A * 2/1950 Lado ..... E02F 3/765 172/785
RE23,886 E * 10/1954 Park et al. ..... A01D 15/00 171/69
2,735,256 A * 2/1956 West ..... A01D 78/06 56/376
2,794,274 A * 6/1957 Robinson ..... E02F 3/7636 172/686
2,891,335 A * 6/1959 Linneman ..... E02F 5/223 404/127

(Continued)

*Primary Examiner* — Jamie L McGowan
(74) *Attorney, Agent, or Firm* — Dale J. Ream

(57) ABSTRACT

A gravel recapturing and sifting apparatus for attachment to a vehicle on a roadway includes a framework that includes a mounting portion selectively coupled to a front of the vehicle and a mounting boom having a proximal end attached to the mounting portion and which extends rearwardly alongside the vehicle. The apparatus includes at least one wheel assembly coupled to an outer face of the mounting boom and being outwardly offset relative to the outer face, the at least one-wheel assembly including a wheel having a plurality of tines and that is rotatable when actuated. The tines are spaced apart and radially arranged so as to kick up and urge gravel in a direction toward the mounting boom while allowing grass and weeds to pass through in an opposite direction.

13 Claims, 6 Drawing Sheets

(56) References Cited

U.S. PATENT DOCUMENTS

| | | | | | |
|---|---|---|---|---|---|
| 2,991,570 | A | | 7/1961 | Resler | |
| 3,319,366 | A | * | 5/1967 | Thompson | E02F 3/7604 37/410 |
| 3,327,413 | A | * | 6/1967 | Brinkmeyer | E02F 3/765 180/419 |
| 3,450,213 | A | * | 6/1969 | Hanserpaule | E02F 3/7604 180/24.11 |
| 4,070,129 | A | * | 1/1978 | Moench, Sr. | E02D 3/032 404/127 |
| 4,446,685 | A | * | 5/1984 | Coeffic | A01D 43/02 56/364 |
| 5,106,165 | A | * | 4/1992 | Lattman | B28D 1/181 172/554 |
| 5,396,756 | A | * | 3/1995 | Franklin | A01D 51/00 56/366 |
| 5,810,097 | A | * | 9/1998 | McMillan | E02F 3/627 172/675 |
| 6,554,080 | B2 | * | 4/2003 | Horner | E02F 3/7636 404/98 |
| 8,146,338 | B1 | * | 4/2012 | Cicci | A01D 78/146 56/385 |
| 2010/0326684 | A1 | | 12/2010 | Mullett | |

* cited by examiner

GRAVEL RECAPTURING AND SIFTING APPARATUS

REFERENCE TO RELATED APPLICATIONS

This application claims the benefit of provisional patent application No. 63/343,165 filed May 18, 2022 titled Gravel Recapturing and Sifting Apparatus, which is incorporated herein in its entirety.

BACKGROUND OF THE INVENTION

This invention relates generally to road grading devices and, more particularly, to a sifting apparatus that kicks up gravel that has been inadvertently graded into a ditch along with grass, brush, and the like, the sifting apparatus directing the gravel toward a roadway from whence it was previously graded while allowing kicked up weeds and grass to fall back into the ditch.

A road grader, which may also be referred to as a motor grader or simply as a grader, is considered a type of heavy equipment that utilizes a long blade set at an angle and used to create a flat surface. Road graders are often used in construction of new highways, foundations for buildings, or for spreading material such as gravel on gravel roads. Typical graders include three axles with the steering wheels in front followed by a grading blade, a cabin with a steering wheel linked to the front wheels, and an engine for actuating the wheels and orientation of the blade.

A major problem with grading rural gravel roads is that the angled blade of a road grader tends to push or throw substantial amounts of existing gravel away from the roadway and into an adjacent ditch rather than merely spreading the existing gravel as intended. Various devices and proposals have been made in the prior art for regulating a material depth, path, or otherwise directing a base of material as may be desired. Although presumably effective for their intended purposes, the existing devices do not recapture previously quantities of gravel that have been unintentionally pushed or directed by a blade of a road grader into a ditch adjacent the roadway from whence the gravel was originally spread.

Therefore, it would be desirable to have a gravel recapturing and sifting apparatus that includes at least one wheel assembly having a plurality of tines that are rotatable when actuated and which are configured to kick up gravel, brush, grass, and even trash from a ground surface adjacent a roadway. Further, it would be desirable to have a gravel recapturing and sifting apparatus in which heavier and bulkier objects such as gravel are thrown in the direction of the roadway while lighter and less dense objects such as grass and brush are allowed to pass through the tines and fall back to the ground surface.

SUMMARY OF THE INVENTION

A gravel recapturing and sifting apparatus according to the present invention includes a framework that includes a mounting portion selectively coupled to a front of the vehicle such as a road grader, and a mounting boom having a proximal end attached to said mounting portion and which extends rearwardly alongside the vehicle. A plurality of wheel assemblies is coupled to the mounting boom and angularly offset therefrom. Each wheel assembly includes a wheel having a plurality of tines and that is rotatable when actuated, the tines being spaced apart and radially arranged so as to kick up and urge gravel in a direction toward said mounting boom while allowing grass and weeds to pass through in an opposite direction.

Therefore, a general object of this invention is to provide a gravel recapturing and sifting apparatus for kicking up gravel, grass, and brush adjacent the roadway and directing kicked up gravel toward the roadway from whence it was previously deposited while allowing grass, brush, and the like onto the ground adjacent the roadway.

Another object of this invention is to provide a gravel recapturing and sifting apparatus, as aforesaid, that may be attached to a road grader and includes a plurality of wheel assemblies each having a wheel constructed of metal tines that rotates when actuated Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A gravel recapturing and sifting apparatus according to a preferred embodiment of the present invention will now be described with reference to FIGS. 1*a* to 5*b* of the accompanying drawings. The gravel recapturing and sifting apparatus 10 for attachment includes a framework 20, at least one wheel assembly 30, each wheel assembly 30 having a plurality of tines 36.

Figure 1A:
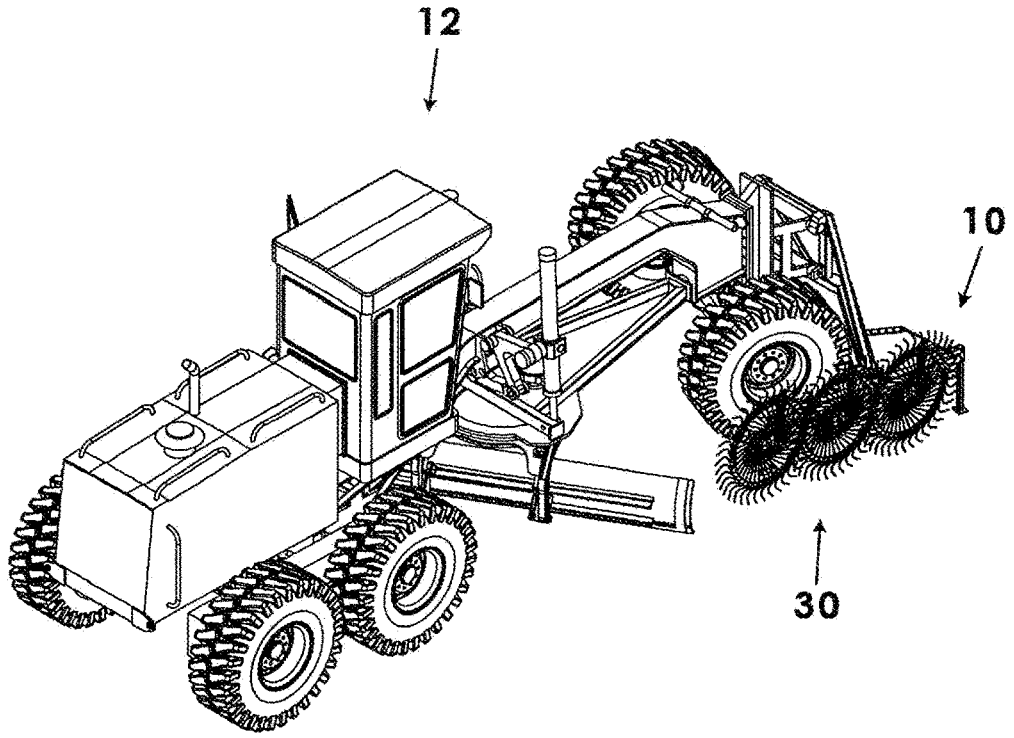
FIG. 1*a* is a right-side perspective view of a gravel recapturing and sifting apparatus according to a preferred embodiment of the present invention, illustrated mounted to a road grader.
Figure 1B:
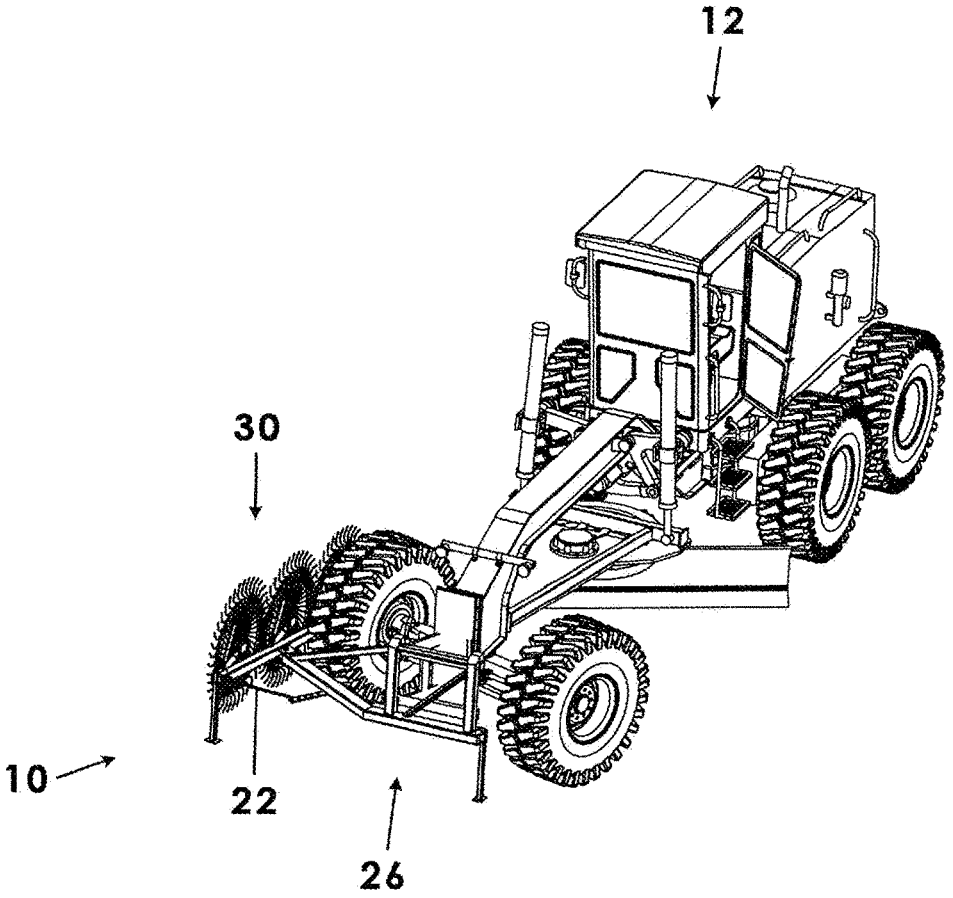
FIG. 1*b* is a left-side perspective view of the gravel recapturing and sifting apparatus as in FIG. 1*a;*
Figure 2:
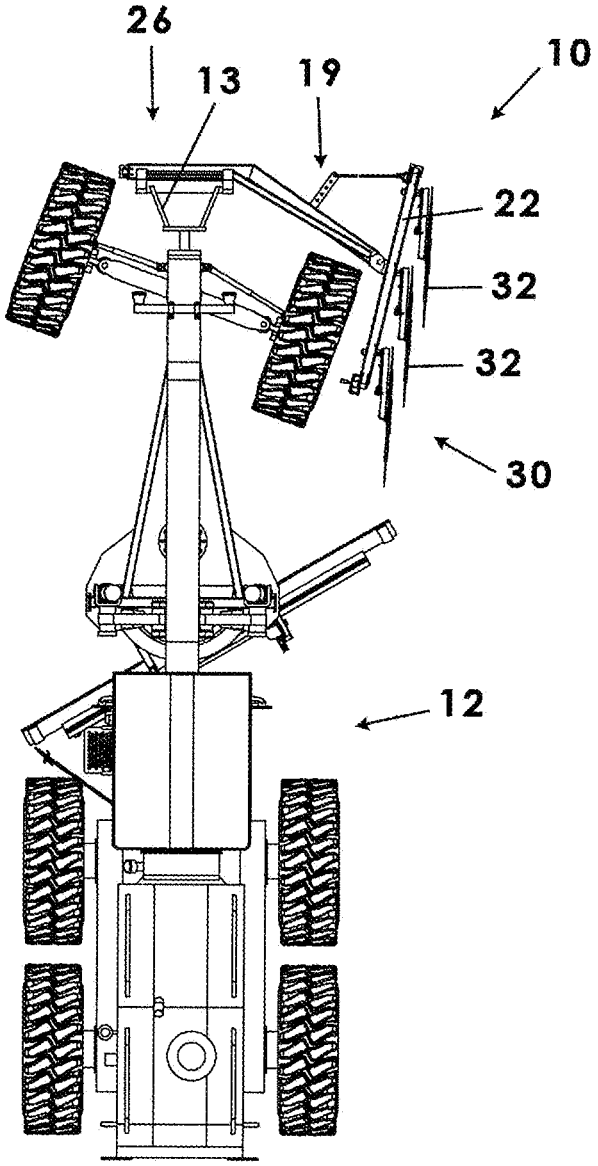
FIG. 2 is a top view of the gravel recapturing and sifting apparatus as in FIG. 1*a;*
Figure 3:
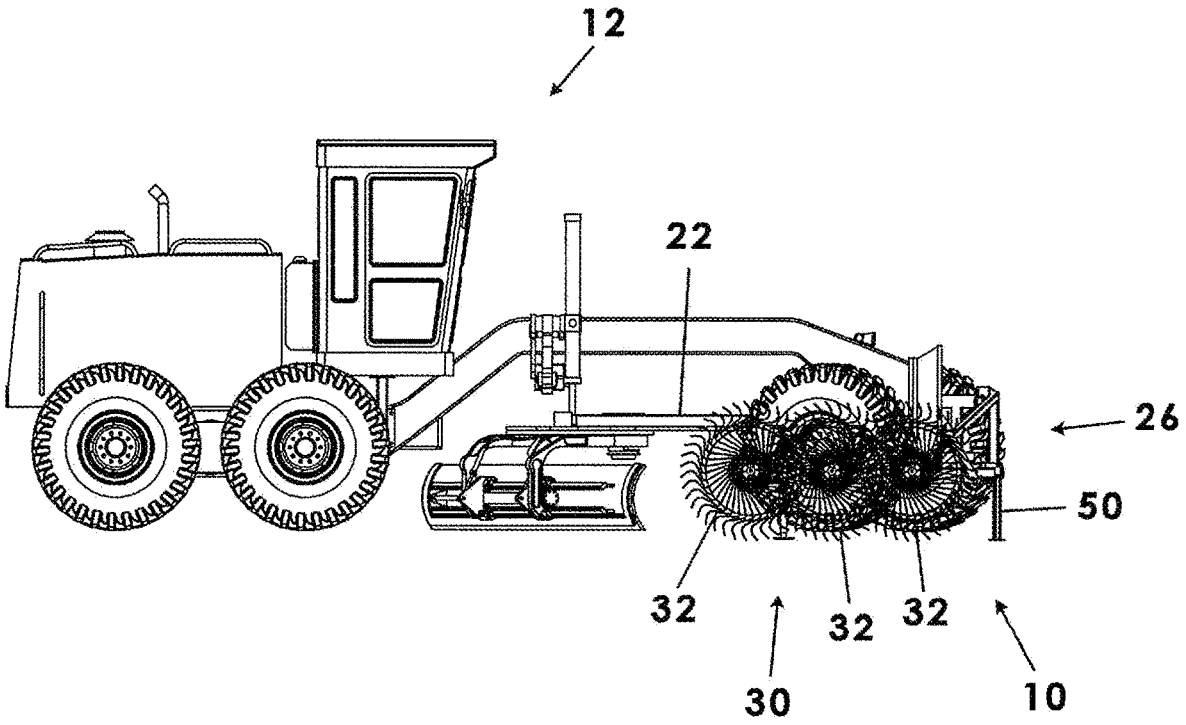
FIG. 3 is a side view of the gravel recapturing and sifting apparatus as in FIG. 1*a;*

For context and clarity, the vehicle 12 to which the gravel recapturing and sifting apparatus 10 may be coupled will be described in greater detail. Preferably, the vehicle 12 is a road grader and the gravel recapturing and sifting apparatus 10 may be selectively and removably coupled to a front thereof or, more particularly, to a complementary attachment framework as will be described later. It will be understood that a road grader is form of heavy equipment with a long blade used to create a flat surface during grading. Modern graders are self-propelled and thus technically "motor graders". Typical graders have three axles, with the steering wheels in front, followed by the grading blade, then a cab and engine atop tandem rear axles. A typical road grader is shown in FIGS. 1-3. In embodiments, the vehicle 12 may be a tractor, other forms of graders or round the leveling equipment, tractors, or the like.

First, the gravel recapturing and sifting apparatus 10 includes a framework 20 having a mounting portion 26 selectively coupled to a front of the vehicle 12 and a mounting boom 22 having an elongate configuration attached to the mounting portion 26 and which extends rearwardly alongside the vehicle 12. In an embodiment, the vehicle 12 may include a mounting framework 13 attached to its normal framework and that is complementary to the mounting portion 26 as will be described below. The mounting portion 26 may include an attachment yoke 28 that may include, amongst other structures, a pair of laterally spaced apart inverted U-shaped flanges 29 that are operative and configured for frictionally nesting atop the mounting framework 13 of the vehicle 12. Further, the attachment yoke 28 may also include at least one boss 27 proximate the pair of flanges 29 by which the yoke 28 may be coupled to the mounting framework 13, such as with a bolt. In addition, the mounting portion 26 may include a base member 27*a* and a pair of posts 27*b* extending upwardly therefrom having upper ends to which the flanges 29 are attached (FIG. 4).

In a preferred embodiment, the mounting portion 26 is coupled to the mounting boom 22. More particularly, the mounting portion 26 includes a positioning strut 21 having a proximal end 21*a* fixedly attached to the mounting portion 26 and a distal end 21*b* pivotally coupled to the mounting boom 22 such that the mounting boom 26 is angularly movable when actuated as will be described below. In other words, the pivotal coupling defines a vertical axis about which the mounting boom 22 may be angularly rotated in such a manner as to correspondingly angle the plurality of wheel assemblies 30.

With further regard to the mounting boom 22, the mounting boom 22 includes a forward end 22*a* and a rearward end 22*b* that is opposite the forward end 22*a*. Determining an angle of the elongate mounting boom 22 and, as a result, the angle of the plurality of wheel assemblies 30, is determined by a critical structure described as follows. A boom positioning member 19 couples the strut 21 with the rearward end 22*b* of the mounting boom 22. More particularly the boom positioning member 19 includes a first portion 19*a* coupled to the strut 21 and defines a plurality of positioning holes 19*b* that are spaced apart from one another. The boom positioning member 19 includes a second portion 19*c* having a first end coupled to the rearward end 22*b* of the of the mounting boom 22 and a second end coupled to a selected hole of the plurality of positioning holes 19*b* so as to angularly position the mounting boom 22, i.e., to swivel or rotate the mounting boom 22 about the vertical axis defined by its pivotal coupling to the strut 21.

In another aspect, the gravel recapturing and sifting apparatus 10 includes at least one wheel assembly 30 coupled to an outer face 23 of the mounting boom 26 and is outwardly offset relative to said outer face 23. Each wheel assembly 30 includes a wheel 32 having a plurality of tines 36 and that is rotatable when actuated. Preferably, and as shown in the illustrations, the gravel recapturing and sifting apparatus 10 includes a plurality of wheel assemblies 30. In an embodiment, each wheel assembly includes an axle 31 extending between the outer face of the mounting boom 22 and a wheel hub 31*a*, the axle 31 providing the angular offset. A respective axle 31 may also be referred to as a wheel shaft. In an embodiment, each wheel includes a hub 31*a* coupled to the respective axle 31, both of which are configured to enable the respective wheel 32 to rotate in a conventional manner. Further, each wheel 30 includes a rim 31*b* having a circular configuration that is concentric (although a larger diameter) to the respective hub 31*a*. Further, each wheel 32 includes a plurality of spokes 35 positioned radially and extending between a respective hub 31*a* and rim 31*b*. Finally, each wheel 32 includes a plurality of tines 36 extending outwardly and spaced apart radially from a respective rim 31*b*. The plurality of tines 36 are spaced apart and radially arranged and each tine 36 preferably has a bent and irregular configuration so as to kick up and urge gravel in a direction toward said mounting boom 26 while allowing grass and weeds to pass through in an opposite direction. Described above is essentially a form of "raking" that is able to recapture gravel back onto a roadway while leaves, grass, and brush are allowed to pass through the tines, spokes, etc.

In another aspect, each wheel assembly 30 may include a spring assembly 40 coupled to each respective axle 31 such that the axle 31 and wheel assembly 30 can move up and down (e.g., can bounce) as an associated wheel 32 rotatably impacts a variable height ground surface as it rotates/turns. In other words, a ditch from which gravel is being recaptured is unlikely to have a smooth or consistent depth or grade and each wheel assembly 30 must have the flexibility and capability to bounce up and down as the vehicle 12 travels downstream adjacent the ditch. More particularly, a spring assembly 40 may include a wheel linkage 42 or framework from which a spring 44 may be coupled at one end, the spring 44 being coupled at an opposite end to a respective axle 31 (FIGS. 4*a* to 5*b*). In an embodiment, the spring 44 may be an expansion or coil spring capable of stretching or being pulled apart and then being resilient to return to its original size and tightness.

Figure 4A:
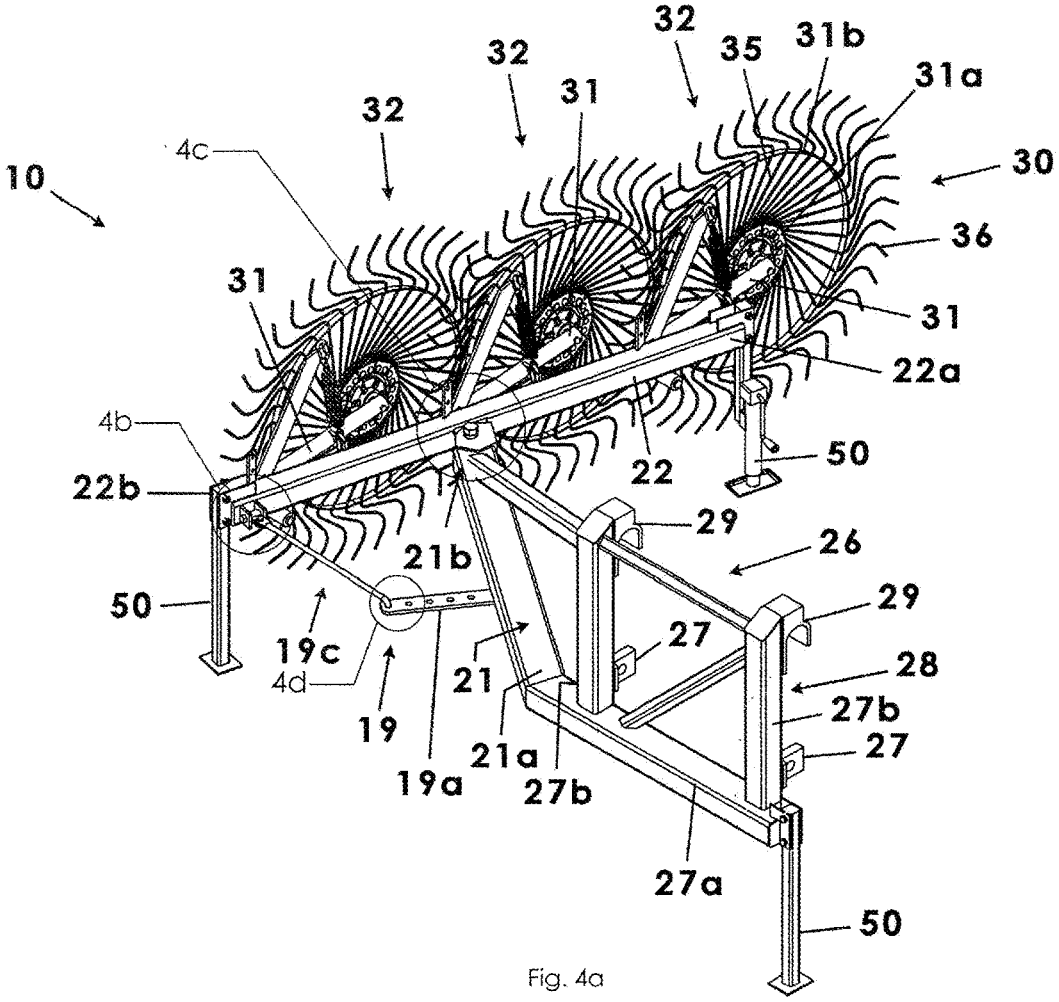
FIG. 4*a* is a perspective view on an enlarged scale of the gravel recapturing and sifting apparatus according to the present invention.
Figure 4B:
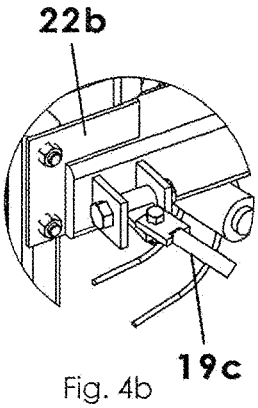
FIG. 4*b* is an isolated view on an enlarged basis taken from FIG. 4*a;*
Figure 4C:
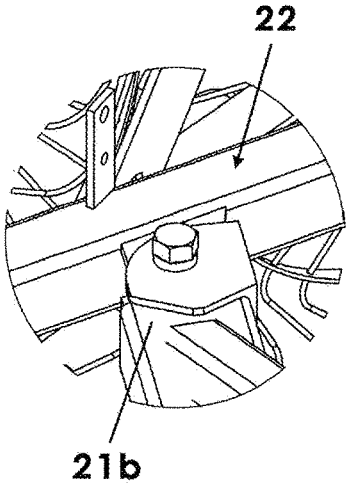
FIG. 4*c* is an isolated view on an enlarged basis taken from FIG. 4*a;*
Figure 4D:
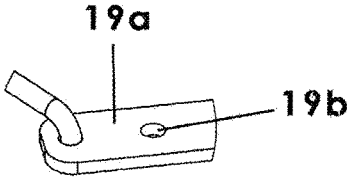
FIG. 4*d* ids an isolated view on an enlarged basis taken from FIG. 4*a;*
Figure 5A:
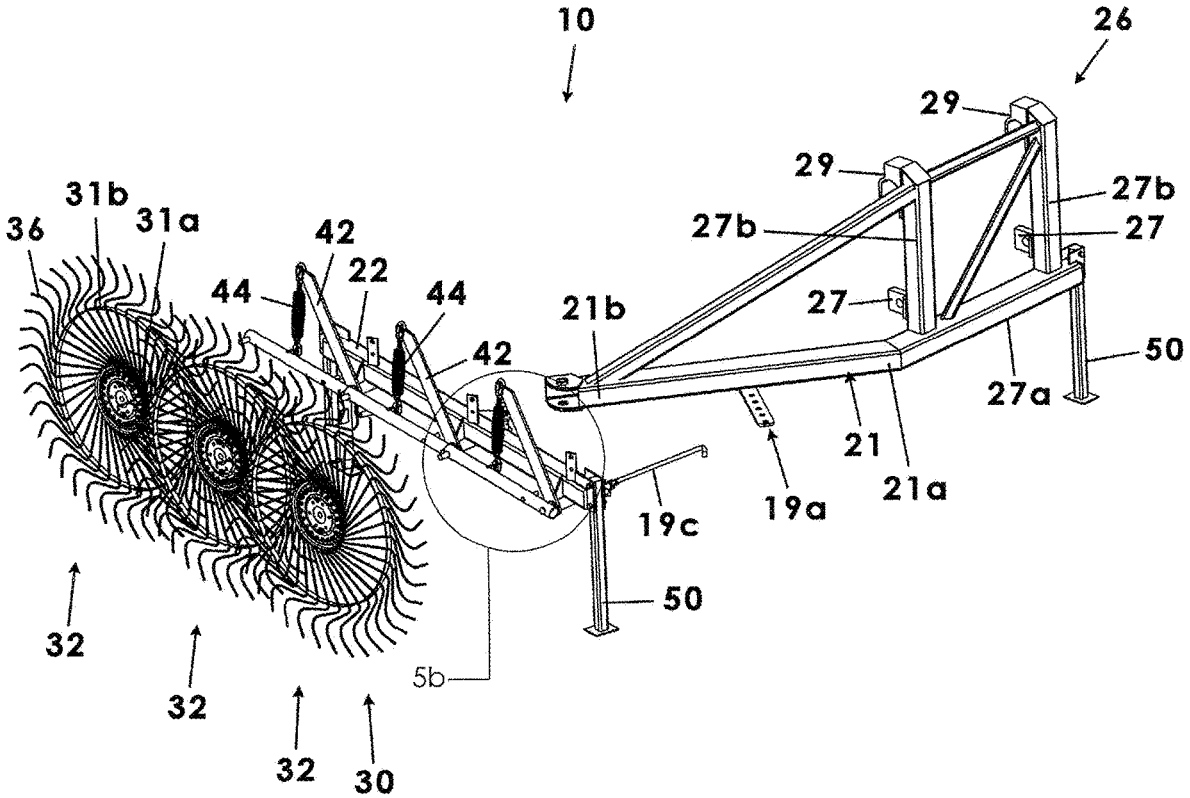
FIG. 5*a* is an exploded view of the gravel recapturing and sifting apparatus as in FIG. 4.
Figure 5B:
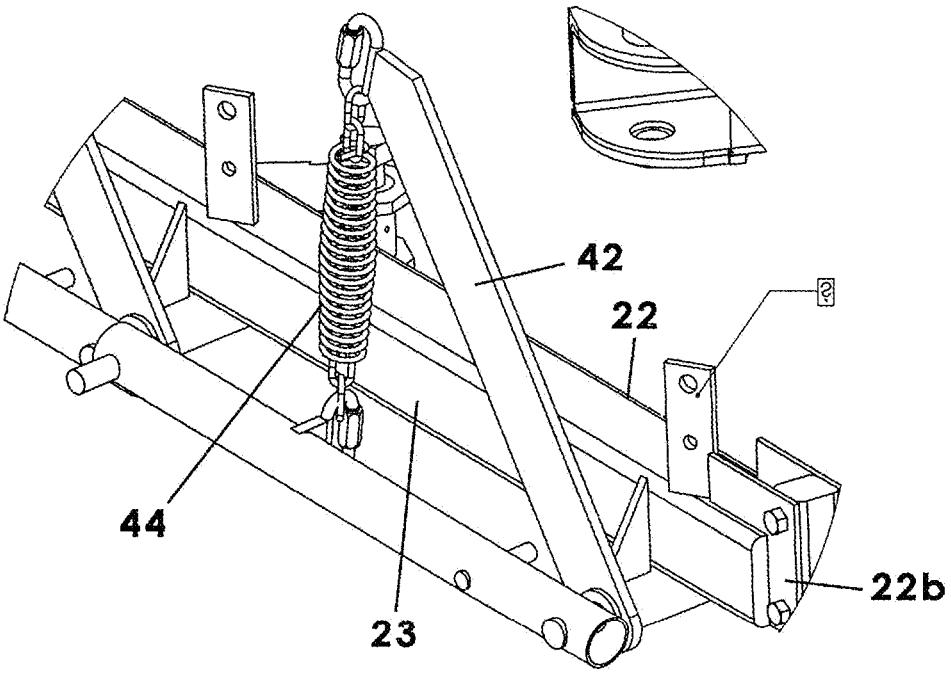
FIG. 5*b* is an isolated view on an enlarged basis taken from FIG. 5*a*.

In another aspect, respective ends of major horizontally-oriented structures may be supported by strategically positioned legs or posts which may, in some embodiments, be implemented using variable height adjustable jacks. Reference numeral 50 is used to refer to the support legs of either construction. More particularly, a support leg or jack may be positioned to extend downwardly from the forward and rearward ends 22*a*, 22*b* of the mounting boom 22 as well as from a terminal end of the mounting portion (FIG. 4*a*).

In use, a gravel recapturing and sifting apparatus includes at least one wheel assembly having a plurality of tines 36 that are rotatable when actuated and which are configured to kick up gravel, brush, grass, and even trash from a ground surface adjacent a roadway. Each wheel assembly includes a raking wheel configured such that heavier and bulkier objects such as gravel are thrown in the direction of the roadway while lighter and less dense objects such as grass and brush are allowed to pass through the tines and fall back to the ground surface.

It is understood that while certain forms of this invention have been illustrated and described, it is not limited thereto except insofar as such limitations are included in the following claims and allowable functional equivalents thereof.

The invention claimed is:

1. A gravel recapturing and sifting apparatus for attachment to a vehicle, comprising:

a framework that includes a mounting portion selectively coupled to a front of the vehicle and a mounting boom having a proximal end attached to said mounting portion and which extends rearwardly alongside the vehicle; and at least one wheel assembly coupled to an outer face of said mounting boom and being outwardly offset relative to said outer face, said at least one wheel assembly including a wheel having a plurality of tines and that is rotatable when actuated;

wherein said plurality of tines are spaced apart and radially arranged so as to kick up and urge gravel in a direction toward said mounting boom while allowing grass and weeds to pass through in an opposite direction wherein said mounting portion includes:

an attachment yoke having an inverted U-shaped configuration for nesting atop a mounting framework associated with the vehicle;

at least one attachment boss releasably coupled to the mounting framework;

a positioning strut having a proximal end fixedly attached to said mounting portion and a distal end pivotally coupled to said mounting boom such that said mounting boom is angularly movable when actuated.

2. The gravel recapturing and sifting apparatus as in claim 1, further comprising a boom positioning member including a first portion coupled to said strut that defines a plurality of positioning holes spaced apart from one another and including a second portion having a first end coupled to a rearward end of said mounting boom and a second end coupled to a selected hole of said plurality of positioning holes of said first portion of said boom positioning member so as to angularly position said mounting boom.

3. The gravel recapturing and sifting apparatus as in claim 1, wherein said at least one wheel assembly includes a plurality of wheel assemblies each having an axle angularly offset from and coupled to said outer face of said mounting boom, respectively, said plurality of wheel assemblies being spaced apart from one another between forward and rearward ends of said mounting boom.

4. The gravel recapturing and sifting apparatus as in claim 3, further comprising a pair of support jacks operatively coupled to and extending downwardly from said forward and rearward ends of said mounting boom, respectively.

5. The gravel recapturing and sifting apparatus as in claim 1, wherein:

said wheel includes a hub and a rim offset from and concentric to said hub;

said wheel includes a plurality of spokes extending radially between said hub and said rim; and said plurality of tines each has a curved configuration and extends outwardly from said rim.

6. The gravel recapturing and sifting apparatus as in claim 3, wherein said plurality of wheel assemblies overlap but do not touch one another.

7. The gravel recapturing and sifting apparatus as in claim 1, wherein the vehicle is a road grader.

8. A gravel recapturing and sifting apparatus for attachment to a road grader, comprising:

a framework that includes a mounting portion selectively coupled to a mounting framework associated with the road grader and a mounting boom having a proximal end attached to said mounting portion and which extends rearwardly alongside the road grader; and a plurality of wheel assemblies operatively coupled to an outer face of said mounting boom, each wheel assembly having an axle that is coupled to and outwardly offset relative to said outer face, said plurality of wheel assemblies each including a wheel that is rotatable about said axle when actuated and including a plurality of tines extending outwardly;

wherein said plurality of tines are spaced apart and radially arranged and operative to kick up and urge gravel in a direction toward said mounting boom while allowing grass and weeds to pass through in an opposite direction;

wherein said plurality of wheel assemblies each includes a spring assembly having a linkage and a spring that allows up-down movement of an associated axle according to variable terrain upon which an associated wheel is raking.

9. The gravel recapturing and sifting apparatus as in claim 8, wherein said mounting portion includes:

an attachment yoke having an inverted U-shaped configuration for nesting atop a mounting framework associated with the vehicle;

at least one attachment boss releasably coupled to the mounting framework;

a positioning strut having a proximal end fixedly attached to said mounting portion and a distal end pivotally coupled to said mounting boom such that said mounting boom is angularly movable when actuated.

10. The gravel recapturing and sifting apparatus as in claim 9, further comprising a boom positioning member including a first portion coupled to said strut that defines a plurality of positioning holes spaced apart from one another and including a second portion having a first end coupled to a rearward end of said mounting boom and a second end coupled to a selected hole of said plurality of positioning holes of said first portion of said boom positioning member so as to angularly position said mounting boom.

11. The gravel recapturing and sifting apparatus as in claim 10, further comprising a pair of support jacks operatively coupled to and extending downwardly from said forward and rearward ends of said mounting boom, respectively.

12. The gravel recapturing and sifting apparatus as in claim 8, wherein:

said each wheel, respectively, includes a hub and a rim offset from and concentric to said hub;

said each wheel, respectively, includes a plurality of spokes extending radially between said hub and said rim; and said plurality of tines each has a curved configuration and extends outwardly from said rim.

13. The gravel recapturing and sifting apparatus as in claim 8, wherein said plurality of wheel assemblies overlap but do not touch one another.

* * * * *